US005291210A

United States Patent [19]

Nakase

[11] Patent Number: 5,291,210

[45] Date of Patent: Mar. 1, 1994

[54] FLAT-PLATE ANTENNA WITH STRIP LINE RESONATOR HAVING CAPACITANCE FOR IMPEDANCE MATCHING THE FEEDER

[75] Inventor: Kazuhiko Nakase, Tokyo, Japan

[73] Assignee: Harada Kogyo Kabushiki Kaisha, Tokyo, Japan

[21] Appl. No.: 902,487

[22] Filed: Jun. 23, 1992

Related U.S. Application Data

[63] Continuation of Ser. No. 438,345, Nov. 16, 1989, abandoned.

[30] Foreign Application Priority Data

Dec. 27, 1988 [JP] Japan ..... 63-330589

[51] Int. Cl.[5] ..... H01Q 1/32

[52] U.S. Cl. ..... 343/700 MS; 343/713; 343/830

[58] Field of Search ..... 343/713, 700 MS, 846, 343/848, 829, 830; H01Q 1/32, 1/27, 1/48, 9/38

[56] References Cited

U.S. PATENT DOCUMENTS 4,761,654 8/1988 Zaghloul ..... 343/700 MS
4,924,236 5/1990 Schuss et al. ..... 343/700 MS

OTHER PUBLICATIONS

Tokumaru, "Multiplates: Low Profile Antennas", A P.S. Jrt'l Symp. 1976 Amherst, Mass., Oct. 14, 1976 pp. 379-382.

*Primary Examiner*—Michael C. Wimer
*Attorney, Agent, or Firm*—Koda and Androlia

[57] ABSTRACT

A flat-plane antenna for mobile communications, used in automobiles, etc. including a table form antenna element made up of a conductive flat-plate section and a plurality of leg sections which connect to the flat-plate section to a ground plate, a strip line resonator provided beneath the table form antenna with a space in between, and a capacitor electrode provided on the strip line resonator directly under the center of the table form antenna element. A feeding line is connected to the strip line resonator.

8 Claims, 4 Drawing Sheets

FLAT-PLATE ANTENNA WITH STRIP LINE RESONATOR HAVING CAPACITANCE FOR IMPEDANCE MATCHING THE FEEDER

This is a continuation of application Ser. No. 438,435, filed Nov. 16, 1989, now abandoned.

BACKGROUND OF THE INVENTION

1. Field of the Invention

The present invention relates to an antenna for use in mobile communications such as automobile telephones and MCA (multi-channel access), etc. which is flat-plate shaped and installed in a flat portion such as roof, trunk lid, etc. of the body of a vehicle such as an automobile, etc.

2. Prior Art

Various types of wire-form or linear antennas have been used in the past as antennas for mobile communications. The reasons for this are that wire-form antennas have maximum radiative characteristics in the horizontal direction, as required for mobile communications, and such antennas can easily be endowed with characteristics which are non-directional in the horizontal plane. Furthermore, antennas used for automobile telephones and MCA require broad-band characteristics, and since broad-band techniques have been well established for wire-form antennas, the design and development of such antennas are relatively easy.

In recent years, flat-plate antennas have received attention as antennas for use in mobile communications. The reason for this is that when a flat-plate antenna is attached to an automobile, there is no projecting object as in the case of conventional and antennas, and there is no deleterious effect on the style of the automobile, and wind noise occurring during operation of the automobile is decreased. Furthermore, since there is no danger that the antenna will contact car-wash machinery, garages or roadside trees, etc., the problem of damage to the antenna from such sources is eliminated. In these and other respects, such antennas have great practical merit.

In flat-plate antennas it is necessary to endow the antenna with broad-band characteristics. For this reason, antennas with a multi-layer structure have been proposed in the past. Such multi-layer antennas, however, has a complex integral structure and is therefore difficult to adapt as a commercial product.

SUMMARY OF THE INVENTION

Accordingly, the object of the present invention is to provide a flat-plate antenna for use in mobile communications which has sufficient broad-band characteristics and has a simple structure.

In the present invention, a strip line resonator is provided inside or underneath a table type antenna element and a capacitor electrode is installed on the strip line resonator at a position directly facing the center of the table type antenna element.

Thus, since in the present invention, a strip line resonator is inside a table type antenna element and a capacitor electrode is installed on the strip line resonator so that it directly faces the center of the table type antenna element. The structure of this antenna is simple and has adequate broadband characteristics.

BRIEF DESCRIPTION OF THE DRAWINGS

FIG. 1(2) is a front view thereof;

FIG. 1(3) is a circuit diagram which illustrates an equivalent circuit thereof;

FIG. 2(2) is an equivalent circuit diagram of the impedance characteristics in the vicinity of the resonant frequency as viewed from the center of the circular plate;

FIG. 3(2) is an equivalent circuit diagram of the impedance characteristics thereof as viewed from the feeding point of the feeder line in this case;

FIG. 4(2) is a front view thereof;

DETAILED DESCRIPTION OF THE INVENTION

Figure 1:
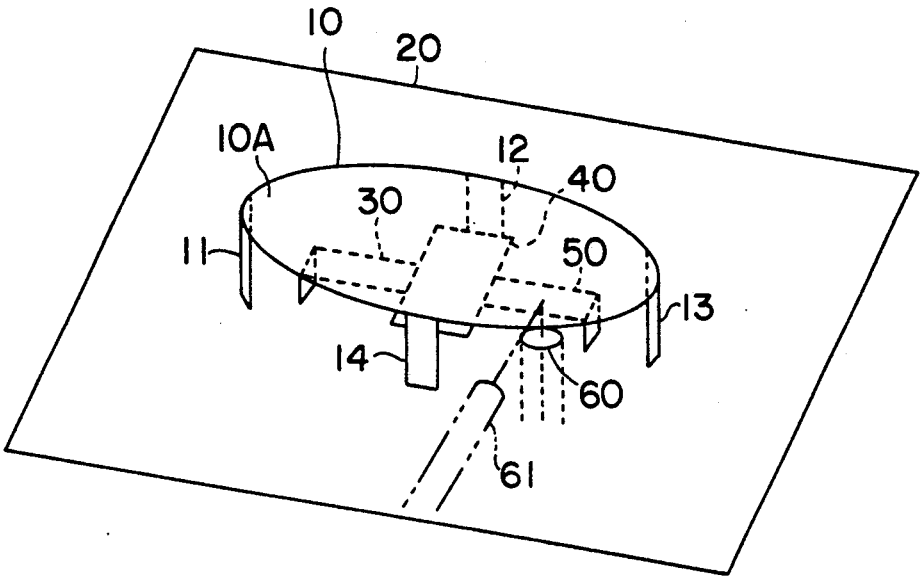
FIG. 1(1) is a perspective view of one embodiment of the present invention.
Figure 1:
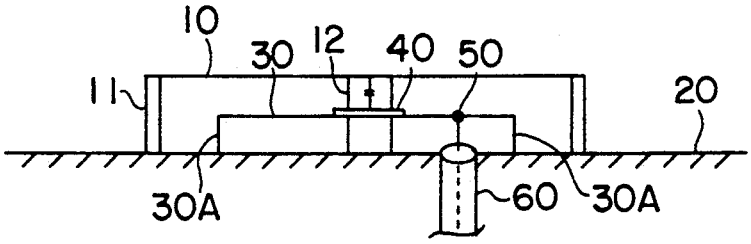
Figure 1:
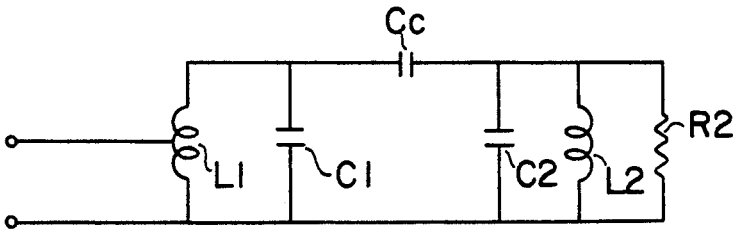

FIG. 1(1) is a perspective view of the antenna of the present invention and FIG. 1(2) is a front view thereof with a connecting plate omitted. FIG. 1(3) is a circuit diagram showing an equivalent circuit of the antenna of FIG. 1(1).

The antenna of the present invention includes the following components: A table type antenna element 10, a ground plate 20 which is under the antenna element 10, a strip line resonator 30 which is installed inside or underneath the table type antenna element 10, and a capacitor electrode 40 which is installed on the strip line resonator 30 in a position opposite the central portion of the table type antenna element 10. In other words, the electrode 40 is directly below the center of the antenna element 10. Furthermore, the antenna of the present invention includes a feeder line 60 which has a feeding point at a prescribed position on the strip line resonator 30.

In particular, the table type antenna element 10 includes a circular or oblong conductive flat-plate 10A and a multiple number of connecting parts 11, 12, 13 and 14, which electrically connect the flat-plate 10A to the ground plate 20. This antenna element 10 is excited in the monopole mode.

Both ends of the strip line resonator 30 are grounded to the ground plate 20 via legs 30A. This strip line resonator 30 also serves as an impedance transformer. The electrostatic capacitance $C_c$ is provided between the capacitor electrode 40 and the table type antenna element 10 and indicated by the capacitor symbol in FIG. 1(2). Moreover, in FIG. 1(1), the feeder line 60 is shown as being led out from beneath the ground plate 20; however, it may also be installed parallel to the ground plate 20 as indicated by reference numeral 61 in FIG. 1(1).

Figure 2:
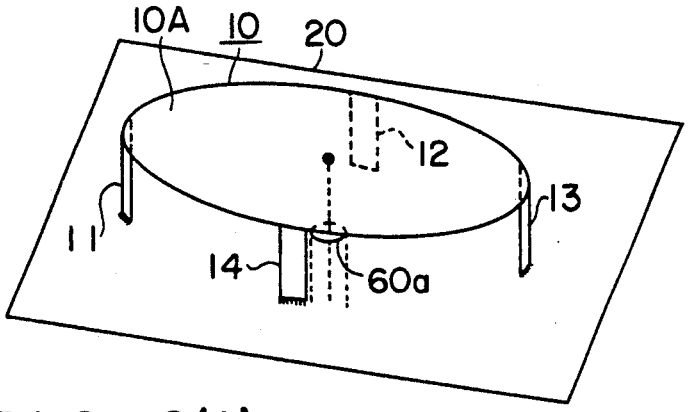
FIG. 2(1) is an explanatory diagram of a table type antenna element of FIG. 1(1) operating in the monopole mode.
Figure 2:
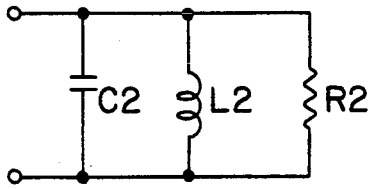

FIG. 2(1) illustrates the relationship between the feeder line 60 and the table type antenna element 10 excited in the monopole mode in the embodiment.

In cases where the table type antenna element 10 is excited in the monopole mode, i.e., where the current flowing through the flat-plate 10A flows uniformly from the center toward the periphery, and the top plate resonates in the lowest-order mode ($\lambda/2$), the voltage distribution reaches the maximum in the central portion of the table type antenna element 10, and the impedance characteristics as viewed from the center of the flat plate 10A may be treated as those of a parallel resonance circuit of the type shown in FIG. 2(2) in the vicinity of the resonant frequency.

Figure 3:
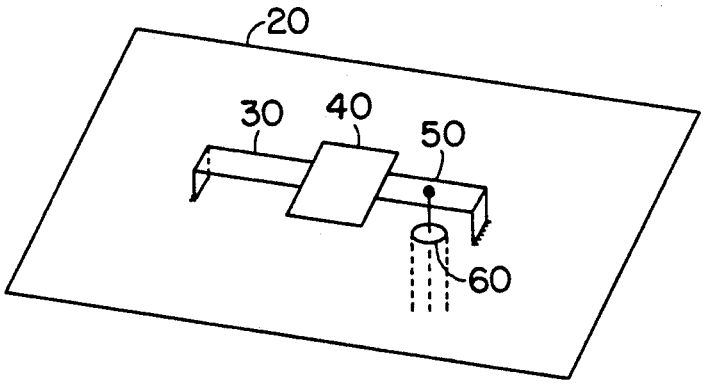
FIG. 3(1) is a perspective view which illustrates a strip line resonator of FIG. 1(1)
Figure 3:
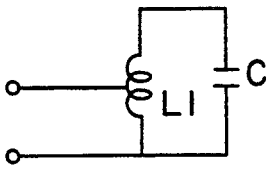

FIG. 3(1) shows the strip line resonator 30 which has both ends grounded and is equipped with the capacitor electrode 40 in the above-described embodiment.

When the resonator shown in FIG. 3 (1) resonates in the lowest-order mode ($\lambda/2$), the voltage in the area of the capacitor electrode 40 reaches the maximum, and the impedance characteristics as viewed from the feeding point 50 of the feeder line 60 may be treated as those of a tapped parallel resonance circuit of the type shown in FIG. 3(2) in the vicinity of the resonant frequency.

The embodiment illustrated in FIGS. 1(1) and 1(2) may be viewed as a combination of the table type antenna element 10 shown in FIG. 2(1) and the strip line resonator shown in FIG. 3(1). In this case, the feeder line 60*a* of FIG. 2(1) is omitted, and the feeder line 60 is used instead. As a result, a primary resonance circuit formed by the strip line resonator 30 and a secondary resonance circuit formed by the table type antenna element 10 are electrostatically coupled by the electrostatic capacitance $C_c$ between the electrode plates. Accordingly, in the embodiment illustrated in FIG. 1(1), a double tuning circuit based on capacitive coupling is formed in apparent terms in the vicinity of the resonant frequency, as shown in FIG. 1(3).

Here, the resonant frequency on the primary side and the resonant frequency on the secondary side are tuned to the frequency being used, the coupling capacitance $C_c$ is set at the critical coupling value, and the position of the feeding point 50 is selected, so that the impedance of the flat-plate antenna of FIG. 1(1) and the impedance of the feeder line are in a matched state. As a result, the reflection loss of the flat-plate antenna for use in mobile communications shown in FIG. 1(1) can be reduced, and a good VSWR value can be obtained across a broad band.

Normally, the necessary conditions for a flat-plate antenna for use in mobile communications such as automobile telephones, etc. is that the antenna must be excellent in certain respects: First, the antenna must have superior directional characteristics. In other words, the antenna must show maximum radiative characteristics in the horizontal direction and must be non-directional within the horizontal plane. Second, the antenna must have broad-band characteristics. For example, in the case of an automobile telephone, the band width must adequately cover 80 MHz band. In Addition, the antenna must have superior impedance matching (matching between the feeder line 60 and the flat-plate antenna for use in mobile communications must be adequately achieved across a broad band), and the antenna should also be superior in terms of its mechanical structure. That is, the structure should be simple and easy to manufacture, and mechanical errors occurring in the manufacturing process should not have any great effect on the antenna characteristics.

First, in regard to the directional characteristics, the table type antenna element 10 is shaped so that it is excited in the monopole mode. In other words, the antenna is shaped so that it has an axially symmetrical flat-plate 10A and a multiple number of connecting parts which electrically connect this flat-plate 10A to the ground plate 20. As a result, the required directional characteristics can be obtained.

Secondly, in regard to broad-band characteristics, flat-plate antennas which are excited in the monopole mode generally have a narrow band width. Broad-band characteristics can be obtained to some extent by connecting the circular plate to a ground plate via a grounding post. However, there are limits to the improvement that can be achieved in this way. Accordingly, in the abovementioned embodiment, broad-band characteristics are obtained by installing a strip line resonator 30 inside the table type antenna element 10, and electrostatically coupling this resonator 30 with the antenna element 10.

The next ting to be considered is an impedance matching. In order to cause stable excitation in the monopole mode, it is ordinarily necessary to position the feeding point in the central portion of the antenna. However, since the center of the antenna is where the voltage is at the maximum, it is difficult to achieve matching between the antenna and the feeder line 60. Accordingly, in the above-described embodiment, feeding is accomplished with the table type antenna element 10 and strip line resonator 30 coupled via the electrostatic capacitance $C_c$. Consequently, the impedance of the flat-plate antenna for use in mobile communications and the impedance of the feeder line 60 can be matched by varying the position of the feeding point 50 between one grounded end of the strip line resonator 30 and the capacitor electrode 40. By using a method in which impedance matching is accomplished by varying the position of the feeding point 50, i.e., by varying the position of the tap, any effect on the antenna proper in terms of directional characteristics and broad-band characteristics, etc., is minimized. Accordingly, the most appropriate position for the feeding point can be selected relatively easily in the development and design stages of the flat-plate antenna.

The mechanical structure of the above-described embodiment is as follows: The table type antenna element 10 and strip line resonator 30 are finished separately from each other in mechanical terms and then these two parts are simply combined. As a result, the mechanical demand in the antenna manufacturing process is minimal. Accordingly, the cost of the product is reduced, and as long as ordinary working precision is maintained, there is no deterioration in the antenna characteristics or insufficiency in terms of the mechanical strength of the antenna. Furthermore, if there is a mechanical dimensional error at the time of assembly tends to result in a change in the coupling capacitance. Even in such cases, however, the only effect will be a certain change in the band width; accordingly, there is no essential effect on the antenna characteristics.

Figure 7:
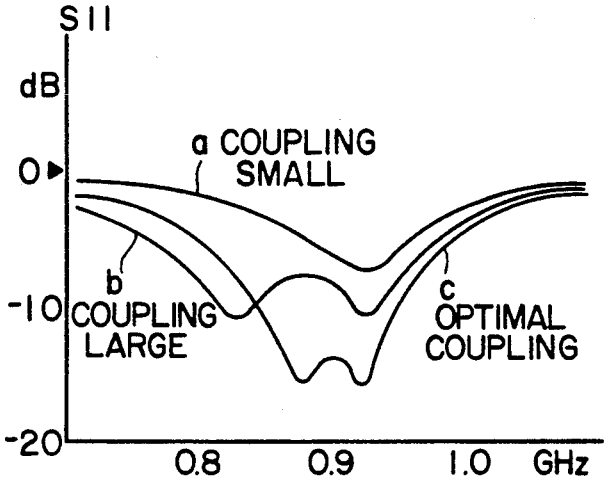
FIG. 7 is a graph which illustrates the reflection loss characteristics with varying coupling capacitance in the embodiment.

FIG. 7 is a graph which shows the change in the reflection loss of the antenna that occurs when the coupling capacitance $C_c$ is varied in the above described embodiment.

Figure 8:
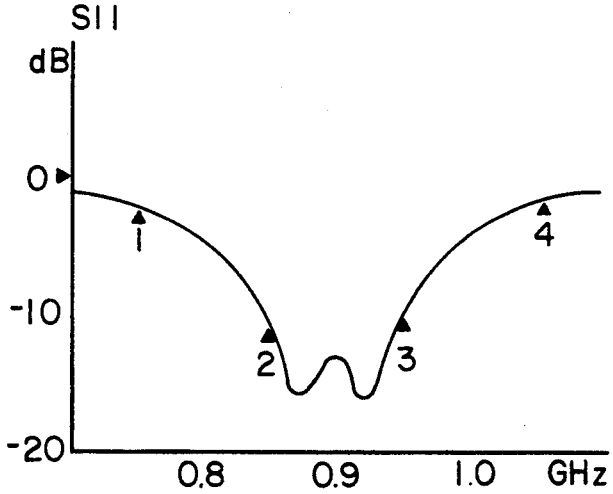
FIGS. 8(1) and 8(2) are graphs which respectively illustrate the reflection loss characteristics and impedance characteristics in the embodiment.
Figure 8:
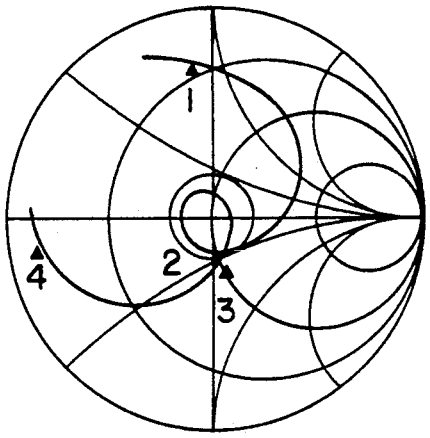

FIG. 8(1) is a graph which shows measurements of the reflection loss in the embodiment; and FIG. 8(2) is a graph which shows one example of impedance characteristics in the embodiment indicated by means of a Smith chart. As for the radiative directional characteristics of the antenna in the embodiment, the direction of maximum radiation of a table-form flat-plate antenna resonating in the monopole mode is more or less horizontal, and such an antenna is more or less non-directional within the horizontal plane.

Figure 9:
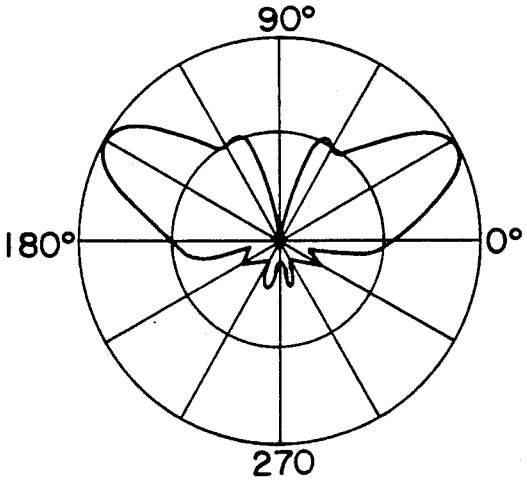
FIG. 9 is a graph which illustrates the directionality of the antenna in the vertical plane in the embodiment.

FIG. 9 is a graph which shows one example of directional characteristics in the vertical plane in a case where the flat-plate antenna of the embodiment is attached to a circular plate-form ground plate with a diameter of 1.5 m.

In the characteristics shown in FIG. 9, the directionality is oriented slightly upward, since a ground plate of finite length is used. However, in cases where a ground plate of an undefined much greater length is used, the directionality is more or less horizontal.

Figure 4:
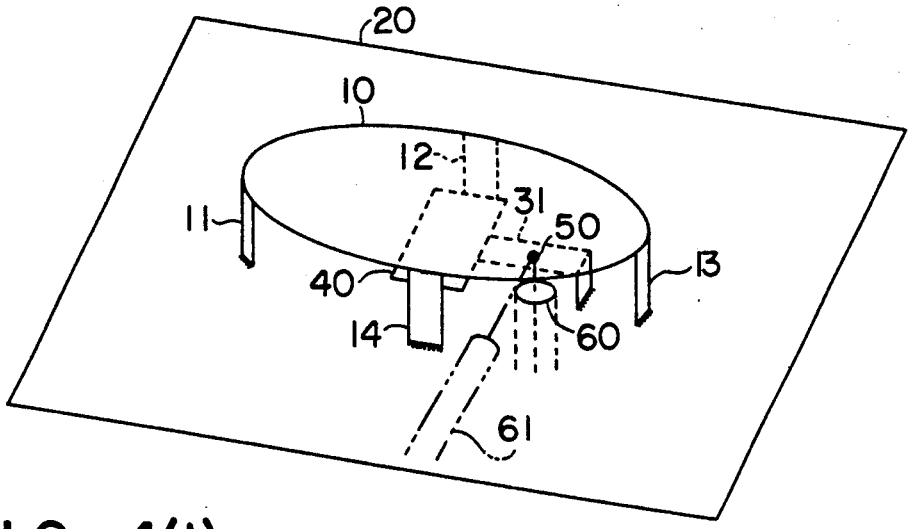
FIG. 4(1) is a perspective view of another embodiment of the present invention.
Figure 4:
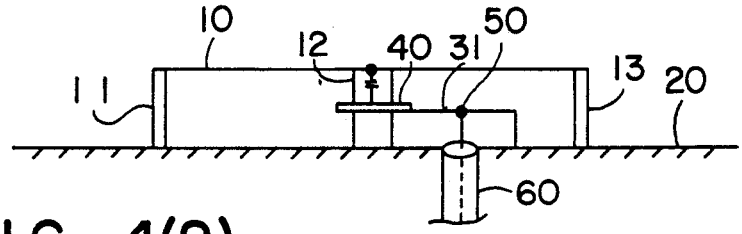

FIG. 4(1) is a perspective view which illustrates another embodiment of the present invention. FIG. 4(2) is a front view thereof with the connecting part 14 shown in FIG. 4(1) omitted.

In this embodiment, a strip line resonator 31, which is approximately half the length of the strip line resonator 30 of the previous embodiment, and is installed on one side only, is used instead of the strip line resonator 30. In this case as well, the capacitor electrode 40 is positioned so that it is located roughly in the center of the table type antenna element 10. Furthermore, in this case as well, an equivalent circuit is formed which is similar to that shown in FIG. 1(3).

Moreover, in the embodiment illustrated in FIG. 4(1), the strip line resonator 31 resonates at one-fourth ($\lambda/4$) the wavelength of the frequency used.

Figure 5:
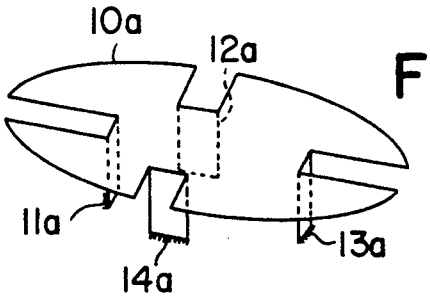
FIG. 5, FIG. 6(1) and FIG. 6(2) are perspective views of modifications of the table type antenna element of the present invention.
Figure 6:
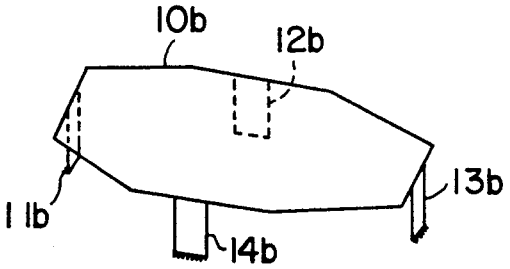
Figure 6:
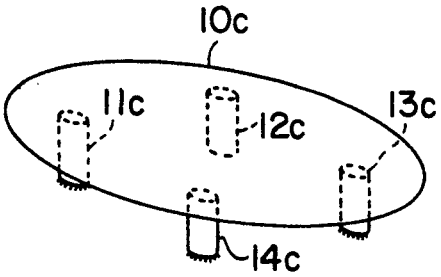

FIGS. 5, 6(1) and 6(2) illustrate modifications of the table type antenna element 10.

In the table type antenna element 10*a* of FIG. 5, the positions of the connecting parts 11*a*, 12*a*, 13*a* and 14*a* are set not at the edges of the table type antenna element 10*a*, but rather at prescribed points which are all substantially equidistant from the center of the antenna. Furthermore, the table type antenna element 10*b* is constructed using a flat-plate which has the shape of a regular octagon. Connecting parts 11*b*, 12*b*, 13*b* and 14*b* are connected to this flat-plate 10*b*. In addition to circular and octagonal flat-plates, it would also be possible to use the flat-plate design with other regular polygonal shapes, e.g., hexagonal, etc. Furthermore, the table type antenna 10*c* may have rod-form connecting parts 11*c*, 12*c*, 13*c* and 14*c*.

In addition, the resonant frequency of the table type antenna can be adjusted by adjusting the size (length, width, diameter) of the connecting parts. Furthermore, it would also be possible to use three connecting parts, or five or more connecting parts, instead of four connecting parts as in the case of the aforementioned connecting parts 11 through 14, 11*a* through 14*a*, 11*b* through 14*b* and 11*c* through 14*c*.

As in detail, the structure of the antenna is simple and has adequate broad-band characteristics.

I claim:

1. A flat-plate antenna for use in mobile telephone communications, said antenna comprising:

a ground plate;

a table type antenna element comprising an elongated conductive flat-plate part spaced apart from said ground plate and a plurality of connecting parts which electrically connect said flat-plate part to said ground plate;

an elongated strip line resonator resonant in the lowest order mode ($\lambda/2$) of said flat-plate antenna provided under a central portion of said conductive plate part of said table type antenna element and spaced apart from both said elongated conductive flat-plate part and said ground plate, said strip line resonator having two ends with each end grounded to said ground plate, wherein $\lambda$ equals the wavelength of the operating frequency of the flat plate antenna;

a capacitor electrode comprising a conductive flat plate coupled to a center portion of said strip line resonator and provided separate from and directly under a central portion of said table type antenna element; and a feeder line being led out from beneath said ground plate and directly connected to an antenna feed point on said strip line resonator spaced apart from said capacitor electrode such that an antenna feed point impedance matches an impedance of said feeder line.

2. A flat-plate antenna according to claim 1, wherein said feed point is provided on said strip line resonator between one grounded end of said strip line resonator and said capacitor electrode.

3. A flat-plate antenna according to claim 1, wherein said elongated conductive flat-plate part of said table type antenna element is circular in shape.

4. A flat-plate antenna according to claim 1, wherein said connecting parts are rod-form conductors.

5. A flat-plate antenna according to claim 1, wherein said capacitor electrode is provided such that the electrostatic capacitive coupling between said table type antenna and strip line resonator is substantially in a state of critical coupling.

6. A flat-late antenna according to claim 1, wherein said elongated conductive flat-plate part of said table type antenna element is regular polygon in shape.

7. A flat-plate antenna according to claim 1, wherein said connecting parts are flat-plate like conductors.

8. A flat plate antenna for use in mobile telephone communications, said antenna comprising:

a ground plate;

a table type antenna element comprising an elongated conductive flat-plate part spaced apart from said ground plate and a plurality of connecting parts which electrically connect said flat-plate part to said ground plate;

an elongated strip line resonator resonant at one-forth of the wavelength of an operating frequency of said flat-plate antenna provided under said table type antenna element, said strip line resonator having two ends with one end of said strip line resonator being grounded to said ground plate, said strip line resonator provided between and spaced apart from both said conductive flat-plate part and ground plate;

a capacitor electrode comprising a conductive flat plate coupled to an other end of said strip line resonator, said strip line resonator and said capacitor electrode being located such that said capacitor electrode is provided under a central portion of said table type antenna element and said capacitor electrode is separate from said table type antenna element; and a feeder line being led out from beneath said ground plate and directly connected to an antenna feed point on said strip line resonator spaced apart from said capacitor electrode such that an antenna feed point impedance matches an impedance of said feeder line.

* * * * *